US005416507A

United States Patent [19]

Otsuka

[11] Patent Number: 5,416,507

[45] Date of Patent: May 16, 1995

[54] CAP DEVICE FOR AN INK JET RECORDING HEAD

[75] Inventor: Yoshinori Otsuka, Kanagawa, Japan

[73] Assignee: Fuji Xerox Co., Ltd., Tokyo, Japan

[21] Appl. No.: 40,031

[22] Filed: Mar. 30, 1993

[30] Foreign Application Priority Data

Mar. 31, 1992 [JP] Japan ..... 4-077755

[51] Int. Cl.[6] ..... B41J 2/165

[52] U.S. Cl. ..... 347/32; 347/30

[58] Field of Search ..... 346/140 R, 75, 1.1; 347/22, 29, 30, 32

[56] References Cited

U.S. PATENT DOCUMENTS 4,410,900 10/1983 Terasawa ..... 346/140 R

FOREIGN PATENT DOCUMENTS 0449324 10/1991 European Pat. Off. ..... 346/140 R
60-104336 6/1985 Japan ..... 346/140 R
3-5160 1/1991 Japan .

*Primary Examiner*—Benjamin R. Fuller
*Assistant Examiner*—John E. Barlow, Jr.
*Attorney, Agent, or Firm*—Finnegan, Henderson, Farabow, Garrett & Dunner

[57] ABSTRACT

A cap device for an ink jet recording head includes a cap, a cap holder, a cylinder, a piston, and a cylinder driver. The cylinder includes therewithin a pump chamber of which the volume increases when the cylinder advances and decreases when the cylinder retracts, an ink discharge path, and communication control unit. When the cylinder advances to increase the volume of the pump chamber, the communication control unit disconnects the pump chamber from the ink discharge path, and when the cylinder retracts to decrease the volume of the pump chamber, the communication control unit connects the pump chamber with the ink discharge path. The piston includes an ink flow path of which the front end communicates with the through-hole and the rear end communicates with the pump chamber within the cylinder when the cylinder advances to reach a predetermined position.

3 Claims, 6 Drawing Sheets

CAP DEVICE FOR AN INK JET RECORDING HEAD

BACKGROUND OF THE INVENTION

The present invention relates to a cap device for an ink jet recording head, which prevents ink settlings from attaching to the ink discharge holes of the recording head. More specifically, the cap device is used for tightly closing the ink discharge holes of the recording head when no printing operation is performed by the ink jet recording device, and for pulling ink to the ink discharge holes from the ink tank when the recording head is first used.

The cap device for an ink jet recording head has a cap of elastic material with an ink reservoir, which is used for forming a space to tightly close the ink discharge holes when it is brought into contact with the ink discharge face of the recording head. The cap device includes means for bringing the cap into contact with the discharge face, and fluid transporting means which pours forth fluid from the space formed between the ink discharge face and the ink reservoir.

Many space saving means have been employed for the cap device. Use of the ink suction pump of small size for the fluid transporting means is one of the space saving means.

A cap head for an ink jet recording head, which is used in the conventional ink jet recording apparatus, is disclosed in Japanese Patent Laid-Open Publication No. Hei. 3-5160. The ink suction pump includes a cylinder, a piston, disposed within the cylinder, having with a piston shaft through-hole and a seal rib formed on the end face of the piston as axially viewed, and a piston shaft, which passes through the through-hole, having a piston holder and a piston receiver, which are respectively disposed on the face of the piston having the seal rib and the face thereof opposed to the former in a state that the piston holder and the piston receiver are oppositely disposed with a predetermined space interposing therebetween. When the piston shaft is moved in the direction in which the piston holder pushes the piston, ink is sucked into the cylinder chamber. When the piston shaft is moved reversely, the sucked ink is discharged through the through-hole.

In the conventional cap device as mentioned above, the cap is moved when the cap having the ink reservoir on the front side is brought into contact with the ink discharging face of the recording head. Further, the piston is moved for operating the suction pump for sucking ink. The direction of the cap movement is different from the piston movement. Therefore, two drive mechanisms to drive the cap and the piston in different directions are required. Requirement of such two drive mechanisms results in complexity of the cap device structure, and hence hinders the size reduction of the cap device.

SUMMARY OF THE INVENTION

The present invention has been made in view of the above circumstances and has an object to provide a cap device for an ink jet recording head which is simple in construction and small in size.

Another object of the invention is to provide a cap device for an ink jet recording head which, by a unidirectional drive mechanism, can move the cap device to and retract the same from the ink discharge face of the recording head, and can suck and discharge ink at high speed.

According to an aspect of the present invention, a cap device for an ink jet recording head comprises a cap having an ink reservoir on the front side and a through-hole through which the ink reservoir communicates with the rear side, the ink reservoir forming a space for tightly closing ink discharge holes formed in the ink discharge side of an ink jet recording head when the cap is brought into contact with the ink discharge side, a cap holder having the cap mounted on the front side thereof, a cylinder located on the rear side of the cap and coupled with the cap holder in a manner that the cylinder is movable forward and backward a predetermined distance with respect to the cap holder, a piston slidably supported by the cylinder in a state that the front end of the piston is protruded from the front end of the cylinder, said piston being constantly urged forward by a coiled spring disposed between the piston and the cylinder, and a cylinder driver for moving forward and rearward the cylinder, wherein the cylinder includes therewithin a pump chamber of which the volume increases when the cylinder advances and decreases when the cylinder retracts; an ink discharge path; and communication control means operating such that when the cylinder advances to increase the volume of the pump chamber, the communication control means disconnects the pump chamber from the ink discharge path, and when the cylinder retracts to decrease the volume of the pump chamber, the communication control means communicates the pump chamber with the ink discharge path, and the piston includes an ink flow path of which the front end communicates with the through-hole and the rear end communicates with the pump chamber within the cylinder when the cylinder advances to reach a predetermined position.

In the cap device, a hollow for receiving an ink absorber, which communicates with the ink discharge path, may be provided on the outer side of the cylinder.

DETAILED DESCRIPTION OF THE PREFERRED EMBODIMENT

A cap device for an ink jet recording head according to an embodiment of the present invention will be described with reference to the accompanying drawings. It should be understood that the present invention is not limited to the specific embodiment to be described hereinafter.

Figure 1:
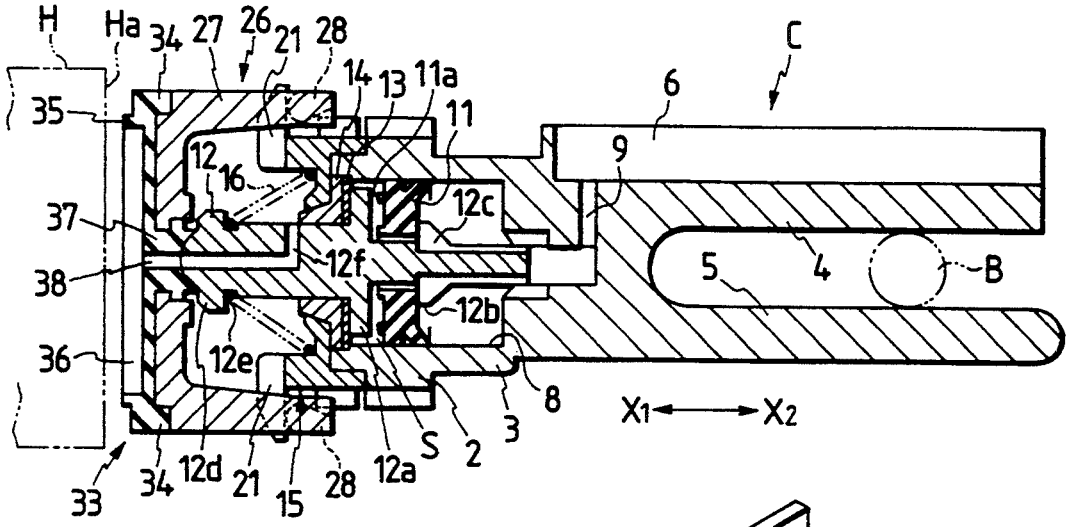
FIG. 1 is a longitudinal sectional view showing a cap device for an ink jet recording head according to an embodiment of the present invention.

In FIG. 1, an ink jet recording head H is indicated by a two-dot chain line.

Figure 9:
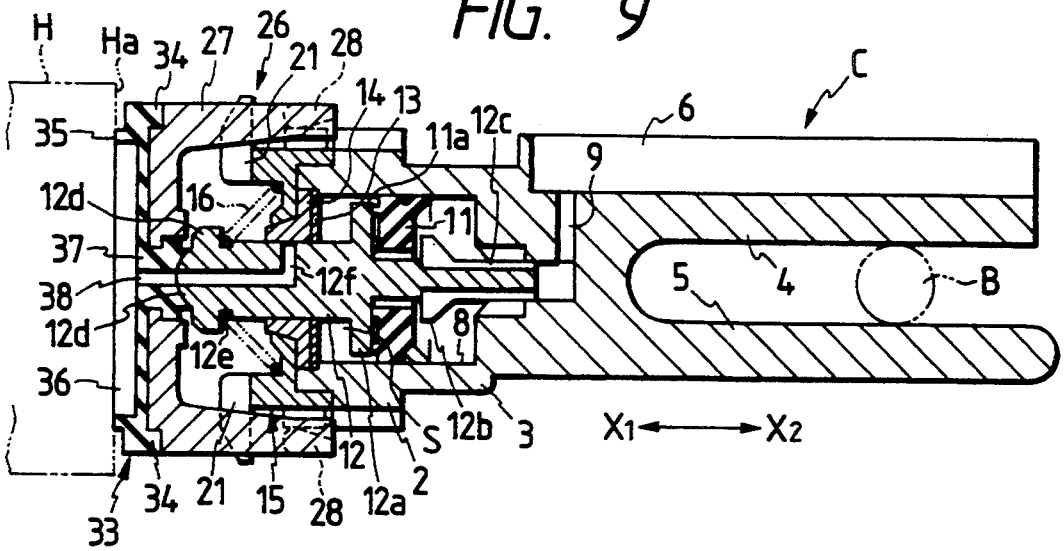
FIG. 9 is a longitudinal sectional view showing the cap device of the present invention, which is useful in explaining the operation of the cap device.
Figure 10:
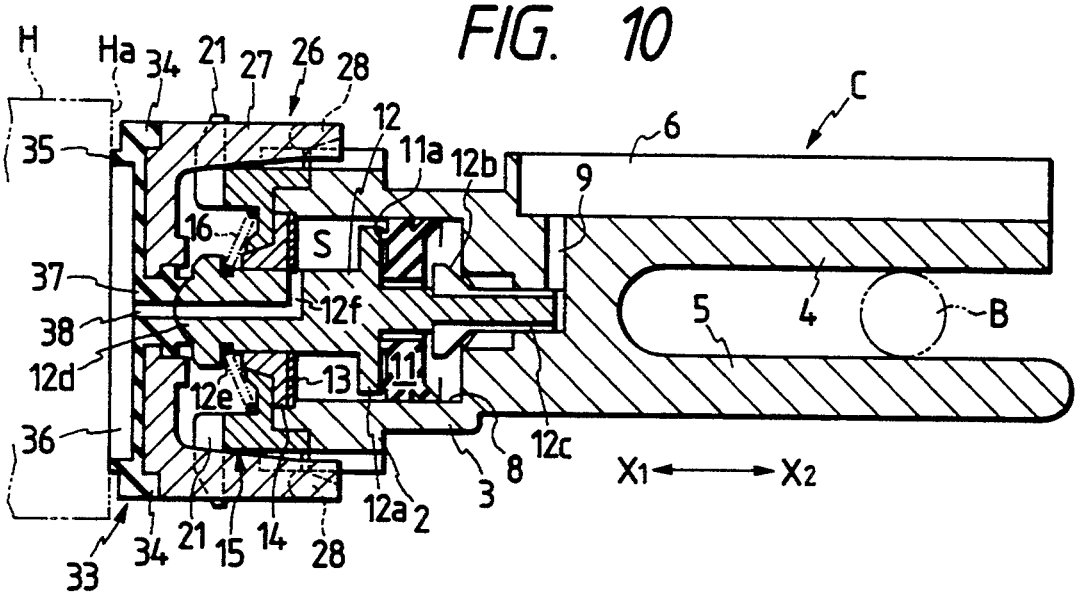
FIG. 10 is another longitudinal sectional view showing the cap device of the present invention, which is also useful in explaining the operation of the cap device.

In the description to follow, the word of "forward" or the like means the direction toward the recording head H (direction indicated by an arrow X1, to the left in FIGS. 1, 9 and 10). The word of "backward" or the like means the direction apart from the recording head H ( the direction indicated by an arrow X2, to the right in FIGS. 1, 9, and 10).

In FIG. 1, the rear end face (right end face in FIG. 1) of the recording head H serves as an ink jetting face Ha having a number of ink jetting holes (not shown) extending vertically in FIG. 1.

In FIG. 1, a cap device C for an ink jet recording head is located on the rear side of the recording head H.

Figure 2:
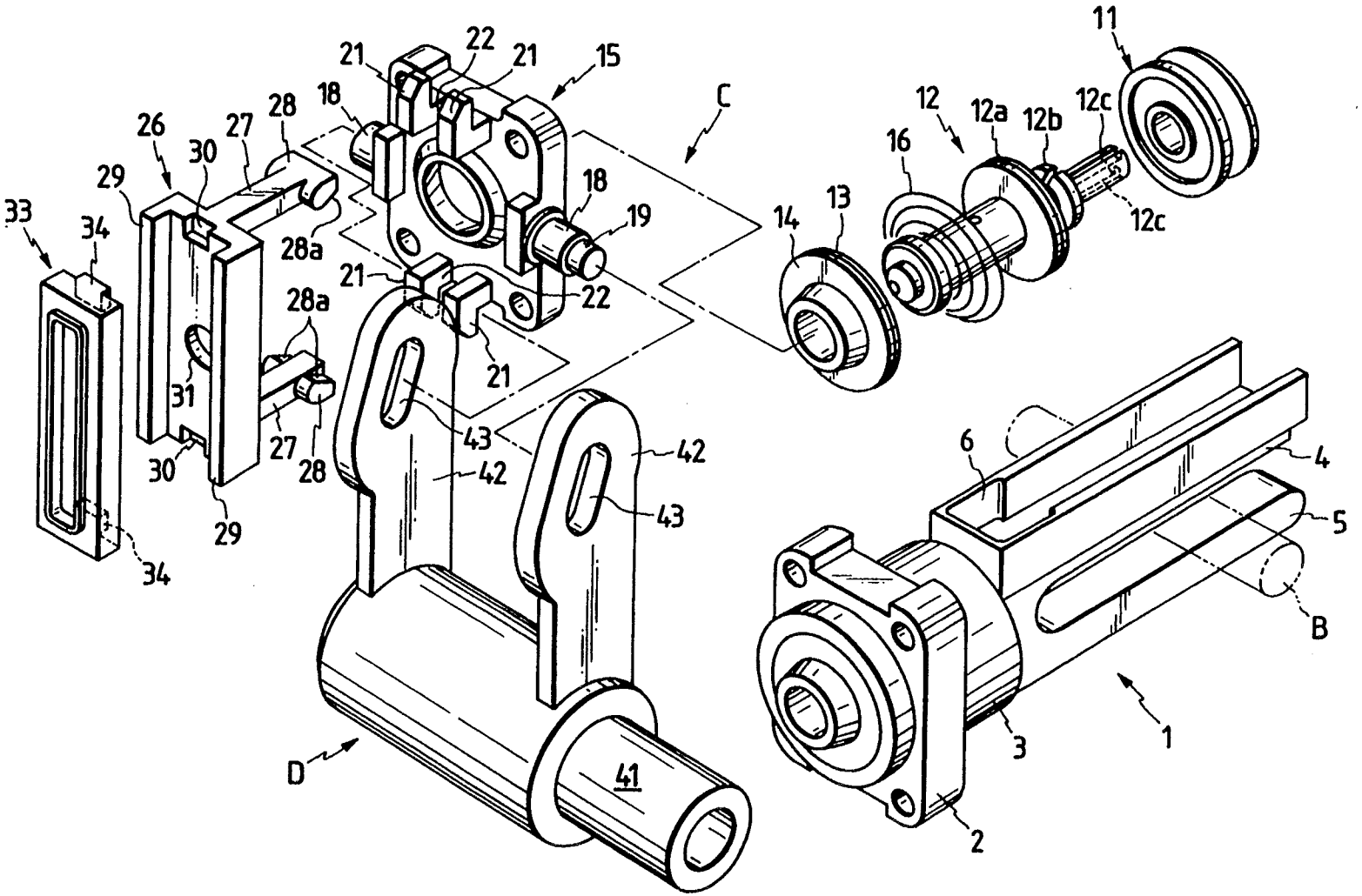
FIG. 2 is an exploded view in perspective of the cap device shown in FIG. 1.
Figure 5:
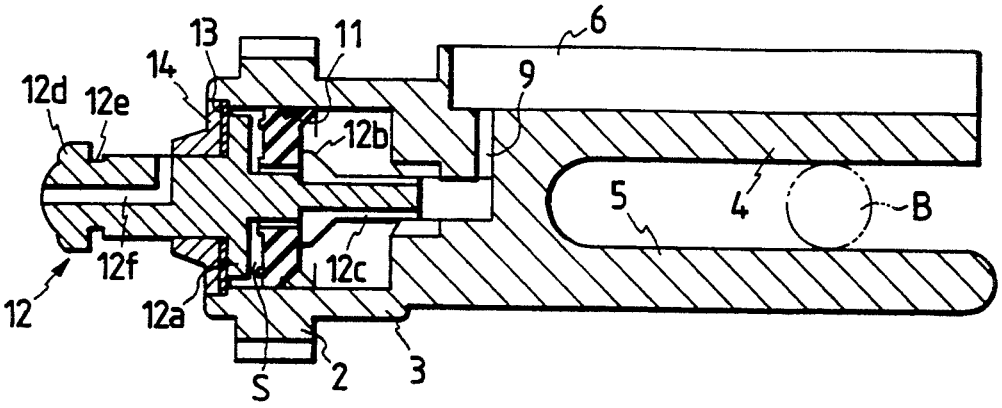
FIG. 5 is a side view, in cross section, of the piston-cylinder combination.

In FIG. 2, there are illustrated, perspectively and in an exploded manner, components forming the cap device C shown in FIG. 1, and a major portion of a cylinder driver D (not shown in FIG. 1) as one of the components of the cap device C.

Referring to FIGS. 1 through 5, the cap device C is provided with a cylinder 1 made of plastic. The cylinder 1 includes a square portion 2 of which external form is square, a tubular portion 3 of which external form is tubular, and plate-like portions 4 and 5, which extend rearward and are vertically arrayed. Those portions 2, 3, and 4 and 5 of the cylinder 1 are contiguously arrayed in this order from the front side (left side in FIG. 1) to the rear side. A hollow 6 for receiving an ink absorber is formed on the top side of the plate-like portion 4. A space between the plate-like portions 4 and 5 provides a guide path through which a fixed guide bar B passes. The guide bar B functions to check the vertical motion of the rear side of the cylinder 1 when it moves forward and backward. When the cap device C is used, an ink absorber (not shown) made of felt, for example, is inserted into the hollow 6.

The cylinder 1 has a cylinder chamber 8 opened to the fore end. The inner surface of the cylinder chamber 8 is circularly curved in cross section. An ink discharge path 9 connects the rear end of the cylinder chamber 8 to the hollow 6.

A packing 11 made of rubber and a piston 12 are contained in the cylinder chamber 8 of the cylinder 1. A seal ring 11*a* slightly projects from the fore end face of the packing 11.

A flange 12*a*, which comes in contact with the packing, and a packing pressure member 12*b* are longitudinally spaced within the piston 12. The outer diameter of each of the flange 12*a* and the packing pressure member 12*b* is smaller than the inner diameter of the cylinder chamber 8. Within the cylinder chamber 8, the packing 11 is disposed between the flange 12*a* and the packing pressure member 12*b*. The outer diameter of the piston 12, which ranges between the flange 12*a* and the packing pressure member 12*b*, is smaller than the inner diameter of the packing 11. As a result, a gap to allow ink to pass therethrough is present between the inner surface of the packing 11 and the outer surface of the piston 12.

The length between the flange 12*a* and the packing pressure member 12*b* is slightly longer than the length of the packing 11 as viewed longitudinally. With this, a small gap is present between the front end face of the packing 11 and the rear end face of the flange 12*a* in a state that the rear end face of the packing 11 is in contact with the front end face of the packing pressure member 12*b* (see FIG. 1). When the front end face of the packing 11 comes in contact with the flange 12*a*, the seal ring 11*a* comes in contact with the rear end face of the flange 12*a*.

A pair of grooves 12*c* and 12*c* allowing ink to pass therethrough, angularly spaced by 180°, are formed in the portion of the piston 12 located more rearward than the packing pressure member 12*b*.

The fore end of the piston 12 consists of an enlarged part 12*d* having a slightly larger outer diameter. A ring groove 12*e* for spring seat is formed around the neck of the enlarged part 12*d*. The front end face of the piston 12 is spherically shaped.

An ink flow path 12*f* is formed in the forward part of the piston 12. The fore end of the ink flow path 12*f* opens at the fore end of the piston 12, while the rear end thereof opens at the circumferential surface of the piston 12.

The fore end of the cylinder chamber 8 containing the piston 12 inserted thereinto is closed by a metal plate 13 and a rubber seal member 14. The plate 13 and the seal member 14 are mounted on the fore end of the cylinder 1. From the fore side thereof, a movably coupling member 15 is applied to the front end face of the square portion 2 of the cylinder 1 and fastened thereto by means of screw means, not shown.

A coiled spring 16 is disposed between the front end face of the movably coupling member 15 and the ring groove 12*e*. The coiled spring 16 urges the piston 12 toward the fore side of the cylinder 1, while it urges the movably coupling member 15, the cylinder 1, and the like toward the rear side of the piston 12. The movably coupling member 15, which movably couples the cylinder 1 with the cap holder (FIGS. 6(A)–6(C)), takes an external form substantially equal to the square portion 2 (FIG. 2) of the cylinder 1.

Pins 18 are protruded from both sides of the movably coupling member 15. One of the pins 18 includes a guide pin 19 further protruded therefrom.

The guide pin 19 engages with a longitudinally elongated guide hole formed in the side wall, not shown, thereby regulating the movement of the movably coupling member 15 and the cylinder 1 coupled therewith in the longitudinal direction.

Figure 3:
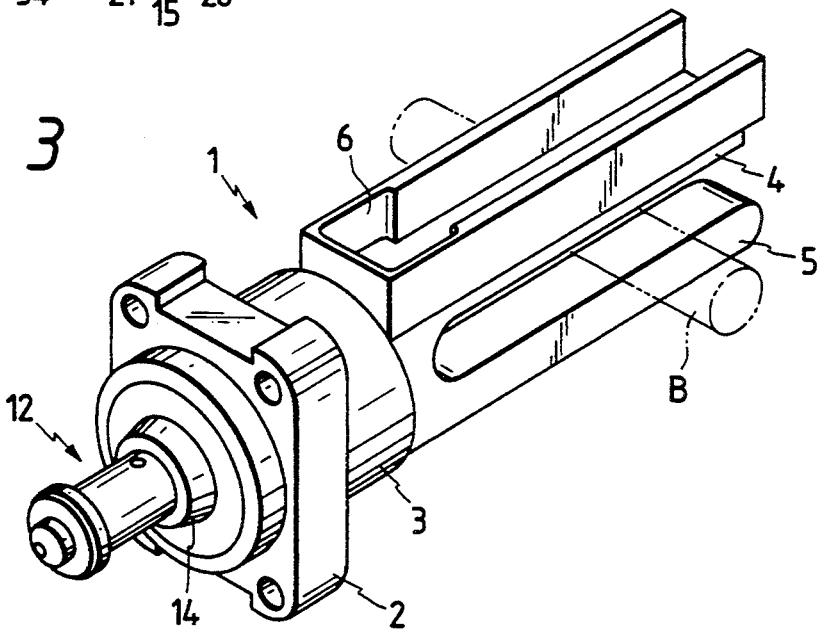
FIG. 3 is a perspective view showing the combination of a piston and a cylinder in the cap device.
Figure 4:
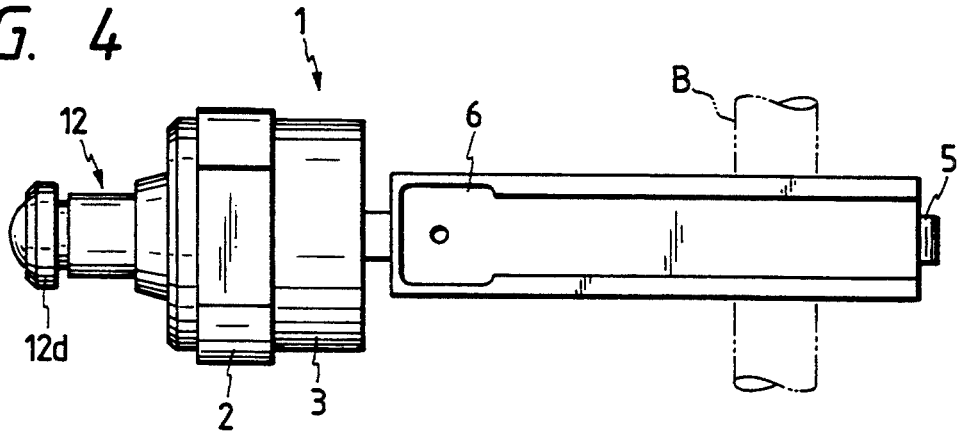
FIG. 4 is a plan view showing the piston-cylinder combination shown in FIG. 3.

Thus, when the cylinder 1 and the movably coupling member 15 move in the longitudinal direction, the vertical motion of the rearward of the cylinder is checked by the guide bar B (FIGS. 1, 2 and 3). The vertical motion of the forward part thereof is checked by the guide pin 19 and the elongated guide hole (not shown) for guiding the guide pin 19.

Figure 6A:
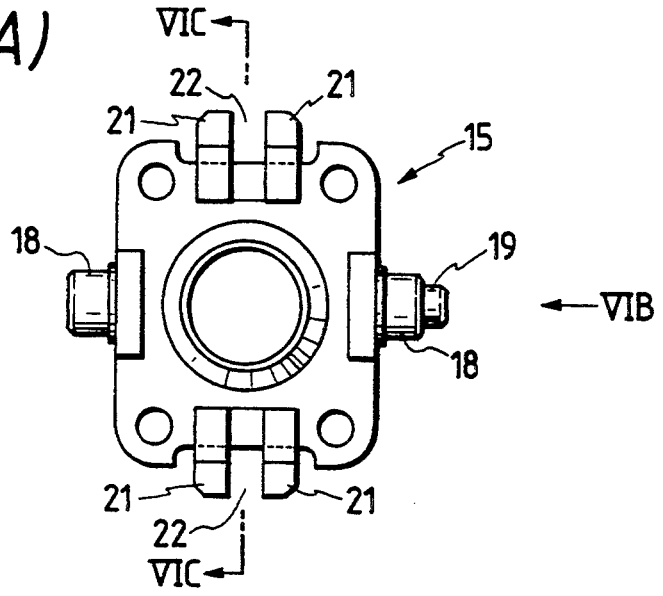
FIG. 6A is a front view showing a movably coupling member for movably coupling a cap holder and a cylinder, which is used in the cap device of FIG. 1.
Figure 6B:
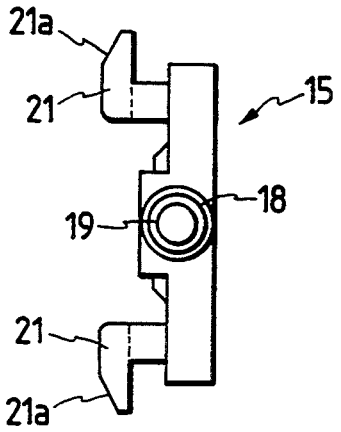
FIG. 6B is a view showing the movably coupling member as seen in the direction of an arrow VIB in FIG. 6A.
Figure 6C:
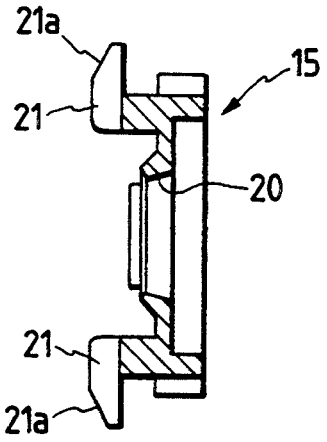
FIG. 6C is a cross sectional view taken on line VIC—VIC in FIG. 6A.
Figure 7A:
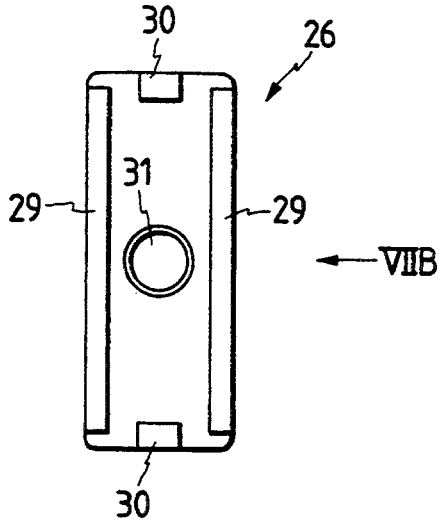
FIG. 7A is a front view showing a cap holder used in the cap device of the invention.
Figure 7B:
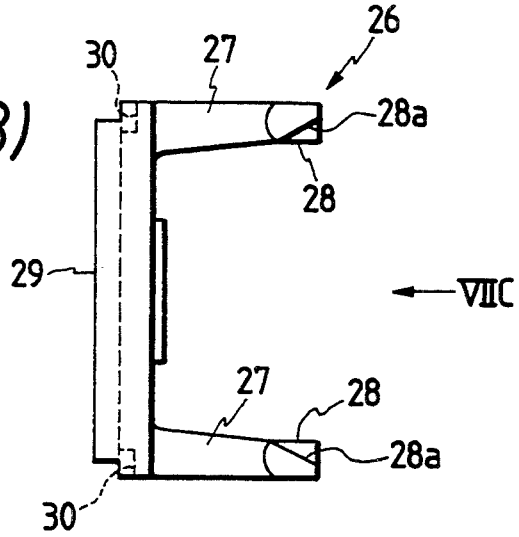
FIG. 7B is a view showing the cap holder as seen in the direction of an arrow VIIB in FIG. 7A.
Figure 7C:
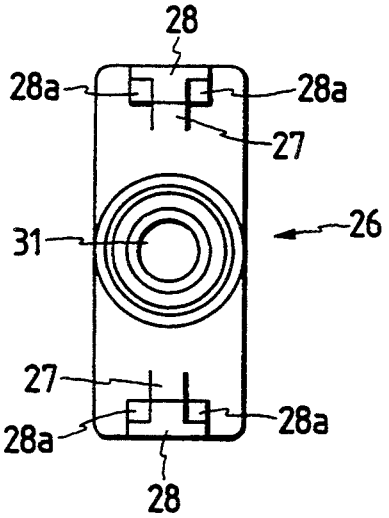
FIG. 7C is a view showing the cap holder as seen in the direction of an arrow VII in FIG. 7B.
Figure 8A:
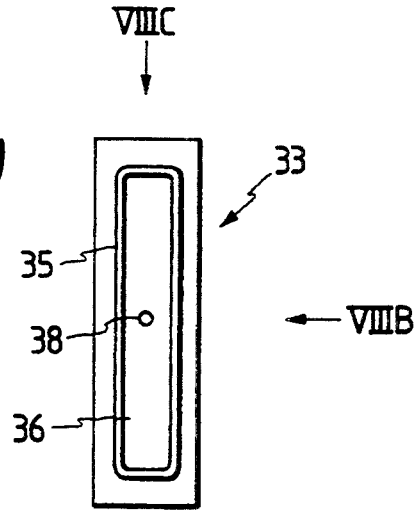
FIG. 8A is a front view showing a cap of the cap device of the invention.
Figure 8B:
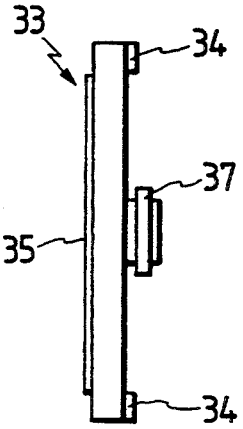
FIG. 8B is a view showing the cap as seen in the direction of an arrow VIIIB in FIG. 8A.
Figure 8C:
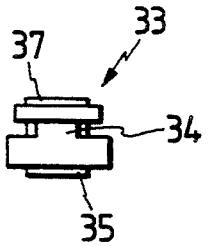
FIG. 8C is a view showing the cap as seen in the direction of an arrow VIIIC in FIG. 8A.

A contact face 20 (FIG. 6C) to come in contact with the front face of the seal member 14 is formed on the rear side of the movably coupling member 15. Paired pawls 21 are provided on the top and bottom of the front face of the movably coupling member 15, as shown. The upper paired pawls 21 have faces 21*a* upward tapered toward the rear side. The upper paired pawls 21 have faces 21*a* downward tapered toward the read side. Each pair of the pawls 21 defines a guide groove 22 (FIGS. 2 and 6A). The guide grooves 22 function to guide arms 27 of a cap holder 26 to be described below.

In FIGS. 1, 2 and 7(A)–7(C), the cap holder 26 made of plastic is provided with a pair of guide arms 27 extending rearward. As seen from FIG. 2, the positioning protrusion 28 of the lower guide arm 27 has a face tapered downward toward the rear side. The positioning protrusion 28 of the upper guide arm 27 has a face tapered upward toward the rear side.

The cap holder 26 and the movably coupling member 15, which are separated in the illustration of FIG. 2, are coupled with each other, as shown in FIG. 1. When the cap holder 26 and the movably coupling member 15 are made to approach to each other, the tapered faces 28*a* of the positioning protrusions 28 are brought into contact with the tapered faces 21*a* of the pawls 21, respectively. At this time, the tapered faces of the positioning protrusions 28 move along those of the pawls 21, and the guide arms 27 are resiliently deformed. As a result, the cap holder 26 and the movably coupling member 15 are coupled with each other as shown in FIG. 1.

In the coupling state of FIG. 1, the guide arms 27 slidably engage with the guide grooves 22 (FIGS. 2 and 6A) each between the paired pawls 21.

At the position where the movably coupling member 15 and the cylinder 1 coupled therewith most retract from the cap holder 26, the pawls 21 are in contact with the positioning protrusions 28, respectively, as seen in FIG. 1. The positioning protrusions 28 provide the rear position of the cylinder 1 with respect to the cap holder 26.

As shown in FIGS. 1, 2, and 7(A)–7(C), cap support walls 29 formed on the cap holder 26 extend vertically. Further, cavities 30 are formed at the top and bottom sides of the front surface of the cap holder 26.

A cap inserting hole 31 is formed at the center of the cap holder 26.

Protrusions 34 are provided on the top and bottom edges of the rear side of the cap 33, which is to be mounted on the front surface of the cap holder 26. The protrusions 34 come in contact with the cavities 30, respectively. A frame 35, defining an ink reservoir 36, is provided on the front surface of the cap 33.

A protrusion 37 is rearward protruded from the center of the rear side of the cap 33. The protrusion 37 is to be inserted into the hole 31 of the cap holder 26. A through-hole 38 is formed at the center of the cap 33. Through the through-hole 38, the ink reservoir 36 is opened to the rear side of the cap 33. The top face of the protrusion 37 of the cap 33 is in contact with the spherical end face of the piston 12. Under this condition, the ink flow path 12*f* of the piston 12 connects to the through-hole 38. Accordingly, the ink flow path 12*f* communicates with the ink reservoir 36 on the front side of the cap, through the through-hole 38.

In FIG. 2, the cylinder driver D is provided with a pair of arms 42 fastened to a rotating shaft 41, which is driven by the combination of a motor and a power transmission mechanism (both not shown). The arms 42 have elongated holes 43. The elongated holes 43 receive the pair of pins 18 extended from both sides of the movably coupling member 15, respectively. The pins 18 of the movably coupling member 15 may be inserted into the elongated holes 43 of the arms 42, utilizing resilient deformation of the arms.

The guide pin 19 further protruded from one of the pins 18 is inserted into an elongated hole of a side wall (not shown) located outside the arms 42. The elongated hole of the side wall extends longitudinally. The guide pin 19, when inserted into the elongated hole, is slidable in the longitudinal direction.

In FIGS. 1, 9, and 10, a pump chamber S is located behind the plate 13 within the cylinder 1. In the state of the cap device shown in FIG. 1, the front face of the packing 11 is separated from the flange 12*a*. Accordingly, the pump chamber S communicates with the hollow 6 by way of the inner hole of the packing 11, the ink paths 12*c*, and the ink discharge path 9.

When the cylinder 1 and the packing 11 advance together and the seal ring 11*a* on the front side of the packing 11 comes in contact with the rear face of the flange 12*a* (see FIGS. 9 and 10), the pump chamber S is disconnected from the inner hole of the packing 11.

When the cylinder 1 further advances from the position of FIG. 9, the packing 11 partially forming the pump chamber S and the flange 12*a* are at a standstill but the plate 13, together with the cylinder 1, advances. As a result, the pump chamber S increases its volume.

When the cylinder retracts from the position of FIG. 9, the packing 11 also retracts together with the cylinder 1. During the retraction of those components, the packing 11 comes in contact with the packing pressure member 12*b* of the piston 12 and is stopped thereat. In this state, the front face of the packing 11 is separated from the flange 12*a*. Accordingly, the pump chamber S communicates with the hollow 6 by way of the inner hole of the packing 11, the ink paths 12*c*, and the ink discharge path 9. When the cylinder 1 further retracts, the packing 11 partially forming the pump chamber S and the flange 12*a* are not moved but the plate 13, together with the cylinder 1, retracts. As a result, the pump chamber S decreases its volume.

Communication control means of the present embodiment is made up of the packing 11, which moves with the movement of the cylinder 1 within a range limited by the piston 12, the flange 12*a*, the packing pressure member 12*b*, the gap between the inner surface of the packing 11 and the outer surface of the piston 12, and the ink paths 12*c*. The communication control means operates such that when the cylinder advances to increase the volume of the pump chamber, the control means disconnects the pump chamber from the ink discharge path, and when the cylinder retracts to decrease the volume of the pump chamber, the control means connects the pump chamber to the ink discharge path.

The operation of the the cap device for an ink jet recording head thus constructed will be described.

In the cap device, the ink reservoir 36 is provided on the front face or side of the cap 33. The cap contains the through-hole 38 communicating the ink reservoir 36 with the rear side of the cap.

The cap 33 is mounted on the front side of the cap holder 26. The cylinder 1 is coupled with the rear side of the cap holder 26 in a manner that it is slidable in the longitudinal direction.

The piston 12 is slidably supported by the cylinder 1. The coiled spring 16 constantly urges the piston 12 in the forward direction. The fore end of the ink flow path 12*f* formed in the piston 12 communicates with the through-hole 38 of the cap 33. The fore end of the piston 12 urged forward by the coiled spring 16 comes in contact with the rear side of the cap 33 or the cap holder 26. Under this condition, the cylinder 1 is pushed rearward by the coiled spring 16, and retained at the position behind the cap holder 26.

In a state that the recording head H is disposed facing the front side of the cap 33, the cylinder 1 is moved forward by the cylinder driver D. With the forward movement of the cylinder, the coiled spring 16, the piston 12, the cap holder 26, and the cap 33 are moved forward in unison. And the front face of the cap 33 comes in contact with the ink jetting face Ha of the recording head H. As a consequence, the ink jetting face Ha and the ink reservoir 36 on the front side of the cap 33 cooperate to form a space tightly closing the ink discharge holes.

In this state, the front side of the cap 33 is in contact with the recording head H. Accordingly, no further advance of the cap 33, the cap holder 26, the piston 12, and the like is permitted. In this state, if the cylinder driver D further drives the cylinder 1 forward, the cylinder 1 continues the forward movement while resisting the coiled spring 16 interposed between it and the piston 12. At this time, the piston 12 supported by the cylinder 1 is not moved. Therefore, the cylinder 1 is moved relative to the piston 12.

With the advancement of the cylinder 1, the volume of the pump chamber S in the cylinder 1 increases. The communication control means in the cylinder 1 shuts off the path between the pump chamber S and the ink discharge path 9 when the volume of the pump chamber S increases.

The ink flow path 12*f* of the piston 12 communicates at the fore end with the through-hole 38 of the cap 33. When the cylinder 1 advances to reach the predetermined position, the ink flow path 12*f* communicates at the rear end with the pump chamber S.

The volume of the pump chamber S has been increased to some degree before the cylinder 1 reaches the predetermined position. Accordingly, the pressure within the pump chamber S has decreased considerably. Accordingly, when the rear end of the ink path 12*f* the fore end of which communicates with the through-hole 38, communicates with the pump chamber S, a large negative pressure abruptly acts on the ink reservoir 36 of the cap 33. By the abrupt application of the negative pressure, the discharge holes opening into the ink reservoir 36 are effectively recovered from the clogged state.

When the volume of the pump chamber S further increases, the fluid within the ink reservoir 36 flows into the pump chamber S.

The space formed by the ink jetting face Ha of the recording head H and the ink reservoir 36 of the cap 33 is filled with ink coming in through the discharge holes. In this state, the discharge holes will not be clogged with ink settlings of dried ink.

When the cylinder 1 is retracted by the cylinder driver D, the volume of the pump chamber S decreases with the retracting motion of the cylinder. At this time, the communication control means communicates the pump chamber S with the ink discharge path 9. Under this condition, the fluid is discharged from the pump chamber S through the ink discharge path 9.

When the cylinder 1 retractively moves to reach a predetermined position, the ink path 12*f* of the piston 12 is disconnected from the pump chamber S (path therebetween is shut off).

The cap device in which a hollow 6 for receiving an ink absorber, which communicates with the ink discharge path 9, is provided on the outer side of the cylinder 1, is used in a state that an ink absorber is set in the hollow 6. Ink discharged through the ink discharge path 9 is absorbed by the ink absorber in the hollow 6.

The operation of the cap device for an ink jet recording head of the invention will be described with reference to FIGS. 1, 9, and 10, from another point of view.

In the state of the cap device C shown in FIG. 1, the cylinder 1 is pushed rearward by the coiled spring 16, so that the piston 12 is pushed forward. The cylinder 1 is positioned by the pawls 21, which are to be brought into the positioning protrusions 28. The piston 12 is positioned by the top face of the protrusion 37 rearward protruded from the cap 33, which the top face is in contact with the front end of the piston 12.

In this state, the front end of the ink flow path 12*f* of the piston 12 connects to the through-hole 38. Accordingly, the ink flow path 12*f* communicates with the ink reservoir 36 on the front face of the cap, by way of the through-hole 38. At this time, the ink path 12*f* is opened at the rear end to atmosphere.

In the state of FIG. 1, since the front face of the packing 11 is separated from the flange 12*a*, the pump chamber S communicates with the hollow 6 by way of the inner hole of the packing 11, the ink paths 12*c*, and the ink discharge path 9.

In the state of FIG. 1, if the rotating shaft 41 of the cylinder driver D is rotated, and the arms 42 is turned forward (FIG. 2), the pins 18, which are extended from both sides of the movably coupling member 15 (the pins 18 engage with the elongated holes 43), are moved forward. At this time, the guide pin 19 is guided along the elongated hole of the side wall, not shown. The cylinder 1, which is integrally coupled with the movably coupling member 15, is guided by the guide bar B.

And the movably coupling member 15 and the cylinder 1 integrally coupled with the member move forward. At this time, the piston 12, the cap holder 26, the through-hole 38, and the like also move forward. The front face of the cap 33 is brought into contact with the ink jetting face Ha of the rear end surface (right end surface in FIG. 1) of the recording head H. The result is to form a space tightly closing the ink jetting holes of the ink jetting face Ha by the ink jetting face Ha of the recording head H and the ink reservoir 36 on the front surface of the cap 33.

When, as shown in FIG. 9, the movably coupling member 15 and the cylinder 1 are further moved forward after the front face of the cap 33 is brought into contact with the ink jetting face Ha, the seal ring 11*a* on the front side of the packing 11 comes in contact with the rear side of the flange 12*a*. Under this condition, the pump chamber S is disconnected from the ink discharge path 9.

When the cylinder 1 is further moved forward, the volume of the pump chamber S increases, so that the pressure within the pump chamber S decreases (negative pressure increases).

When the cylinder 1 is further moved forward as shown in FIG. 10, the rear end of the ink flow path 12*f* communicates with the pump chamber S. At this time, the pressure within the pump chamber S has greatly decreased, a large negative pressure instantaneously acts on the ink reservoir 36 on the front side of the cap 33. As a result, the ink discharge holes (not shown) opening at the ink jetting face Ha are recovered from the clogged state.

At this time, the fluid within the ink reservoir 36 flows into the pump chamber S. The space formed by the ink jetting face Ha of the recording head H and the ink reservoir 36 of the cap 33 is filled with ink flowing through the ink discharge holes. In this state, the clogging of the ink discharge holes, which results from the ink being dried, will never take place.

When the cylinder 1 is moved rearward by the cylinder driver D, the volume of the pump chamber S becomes small with the rearward movement of the cylinder. The packing 11 moves rearward together with the cylinder 1, so that a gap between the front side of the packing 11 and the rear side of the flange 12*a* is formed, and the pump chamber S communicates with the ink discharge path 9. Under this condition, the fluid in the pump chamber S is discharged through the ink discharge path 9.

When the cylinder 1 retracts to a preset position (FIG. 9), the rear end of the ink flow path 12*f* is disconnected from the pump chamber S (the passage therebetween is shut off). The fluid within the pump chamber S is continuously discharged through the ink discharge path 9 and is absorbed by the ink absorber located in the hollow 6 outside the cylinder 1.

If required, the hollow 6 for receiving the ink absorber may be substituted by an ink tank. Further, the cylinder 1 per se may have a coupling member for the cap holder 26. In this case, the movably coupling member 15 is not used.

As seen from the foregoing description, the cap device for an ink jet recording head has the following advantageous features:

a) An ink suction efficiency is high, with useless consumption of little ink. This arises from the short distance between the pump chamber and the cap.

b) Quick recovery of the ink discharge holes from the clogged state is secured. This is due to the fact that the negative pressure abruptly acts on all of the ink discharge holes.

c) The mechanism to recover the ink discharge holes from being clogged is simple, because the operation of the mechanism is unidirectional.

d) The cap device is operable at an increased speed because of the simple mechanism and the short distance between the pump chamber and the cap.

The foregoing description of preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A cap device for an ink jet recording head comprising:

a cap having an ink reservoir on a front side and a through-hole communicating the ink reservoir with a rear side, the ink reservoir forming a space for tightly closing ink discharge holes formed in an ink discharge side of the ink jet recording head when the cap contacts the ink discharge side;

a cap holder having a front side to mount the cap;

a cylinder, having a front end located on the rear side of the cap, and coupled with the cap holder in a manner so that the cylinder is movable toward and away from the cap holder through a predetermined distance;

a piston slidably supported by the cylinder so that a front end of the piston protrudes from the front end of the cylinder, the piston being constantly urged toward the cap by a coiled spring disposed between the piston and the cylinder, the front end of the piston being between the front end of the cylinder and the rear side of the cap; and a cylinder driver for moving the cylinder toward and away from the cap holder.

2. A cap device for an ink jet recording head claimed in claim 1, wherein the cylinder includes:

a pump chamber of which a volume increases when the cylinder advances and decreases when the cylinder retracts;

an ink discharge member; and communication control unit for operating an operation that when the cylinder advances to increase the volume of the pump chamber, the communication control unit disconnecting the pump chamber from the ink discharge member, and when the cylinder retracts to decrease the volume of the pump chamber, the communication control unit communicates the pump chamber with a ink discharge path.

3. The cap device according to claim 1, in which the piston including an ink flow path of which a front end communicates with the through-hole and a rear end communicates with the pump chamber within the cylinder when the cylinder advances to reach a predetermined position.

* * * * *

UNITED STATES PATENT AND TRADEMARK OFFICE

CERTIFICATE OF CORRECTION

PATENT NO. : 5,416,507

DATED : May 16, 1995

INVENTOR(S) : Yoshinori OTSUKA

It is certified that error appears in the above-indentified patent and that said Letters Patent is hereby corrected as shown below:

Claim 2, Column 10, Line 49, change "a" to --an--.

Signed and Sealed this

Twenty-first Day of November, 1995

Bruce Lehman

*Attest:*

BRUCE LEHMAN

*Attesting Officer*

*Commissioner of Patents and Trademarks*